US007658471B2

(12) United States Patent
Matsuno et al.

(10) Patent No.: US 7,658,471 B2
(45) Date of Patent: Feb. 9, 2010

(54) DROPLET JET HEAD AND DROPLET JET APPARATUS

(75) Inventors: Yasushi Matsuno, Matsumoto (JP); Masahiro Fujii, Shiojiri (JP); Akira Sano, Matsumoto (JP)

(73) Assignee: Seiko Epson Corporation (JP)

( * ) Notice: Subject to any disclaimer, the term of this patent is extended or adjusted under 35 U.S.C. 154(b) by 635 days.

(21) Appl. No.: 11/354,619

(22) Filed: Feb. 15, 2006

(65) Prior Publication Data

US 2006/0186174 A1 Aug. 24, 2006

(30) Foreign Application Priority Data

Feb. 21, 2005 (JP) ..... 2005-043513

(51) Int. Cl.
*B41J 2/14* (2006.01)

(52) U.S. Cl. ..... 347/50; 347/58; 347/68; 347/70

(58) Field of Classification Search ..... 347/50, 347/57–59, 64, 68, 70, 71
See application file for complete search history.

(56) References Cited

U.S. PATENT DOCUMENTS 6,406,133 B1 6/2002 Abe
6,582,066 B1 6/2003 Temple

FOREIGN PATENT DOCUMENTS

| | | | |
|---|---|---|---|
| JP | 09-226115 | * | 9/1997 |
| JP | 09226115 | | 9/1997 |
| JP | 2000-512233 | | 9/2000 |
| JP | 2001-096740 | | 4/2001 |
| JP | 2002-210969 | | 7/2002 |
| JP | 2003-305848 | | 10/2003 |
| JP | 2004-058589 | | 2/2004 |

* cited by examiner

*Primary Examiner*—Matthew Luu
*Assistant Examiner*—Henok Legesse
(74) *Attorney, Agent, or Firm*—Harness, Dickey & Pierce, P.L.C.

(57) ABSTRACT

A droplet jet head includes a nozzle substrate having a plurality of nozzle holes; a cavity substrate having recesses whose bottoms serve as diaphragms, and the recesses serving as ejection chambers; an electrode substrate having separate electrodes opposed to the diaphragms; a reservoir substrate having a recess serving as a common droplet chamber for supplying droplets to the ejection chambers, through holes for transferring the droplets from the common droplet chamber to the ejection chambers, and nozzle communicating holes for transferring the droplets from the ejection chambers to the nozzle holes; and a driver IC that supplies a driving signal to the separate electrodes. The cavity substrate has a first hole, and the reservoir substrate has a second hole. The first hole and the second hole communicate with each other to form a housing. The driver IC is housed in the housing.

10 Claims, 7 Drawing Sheets

1: DROPLET DISCHARGE HEAD
2: ELECTRODE SUBSTRATE
3: CAVITY SUBSTRATE
4: RESERVOIR SUBSTRATE
5: NOZZLE SUBSTRATE
6: RECESS
7: SEPARATE ELECTRODE
10a: DROPLET SUPPLY PORT
10b: DROPLET SUPPLY PORT
10c: DROPLET SUPPLY PORT
11: DIAPHRAGM
12: DISCHARGE CHAMBER
12a: RECESS
13: COMMON DROPLET CHAMBER
13a: RECESS
14: THROUGH HOLE
15: NOZZLE COMMUNICATING HOLE
16: NOZZLE HOLE
20: DRIVER IC
21: FIRST HOLE
22: COMMON ELECTRODE
23: SECOND HOLE
25: LEAD
30: FPC
31: IC WIRE
32: COMMON-ELECTRODE WIRE

FIG. 1

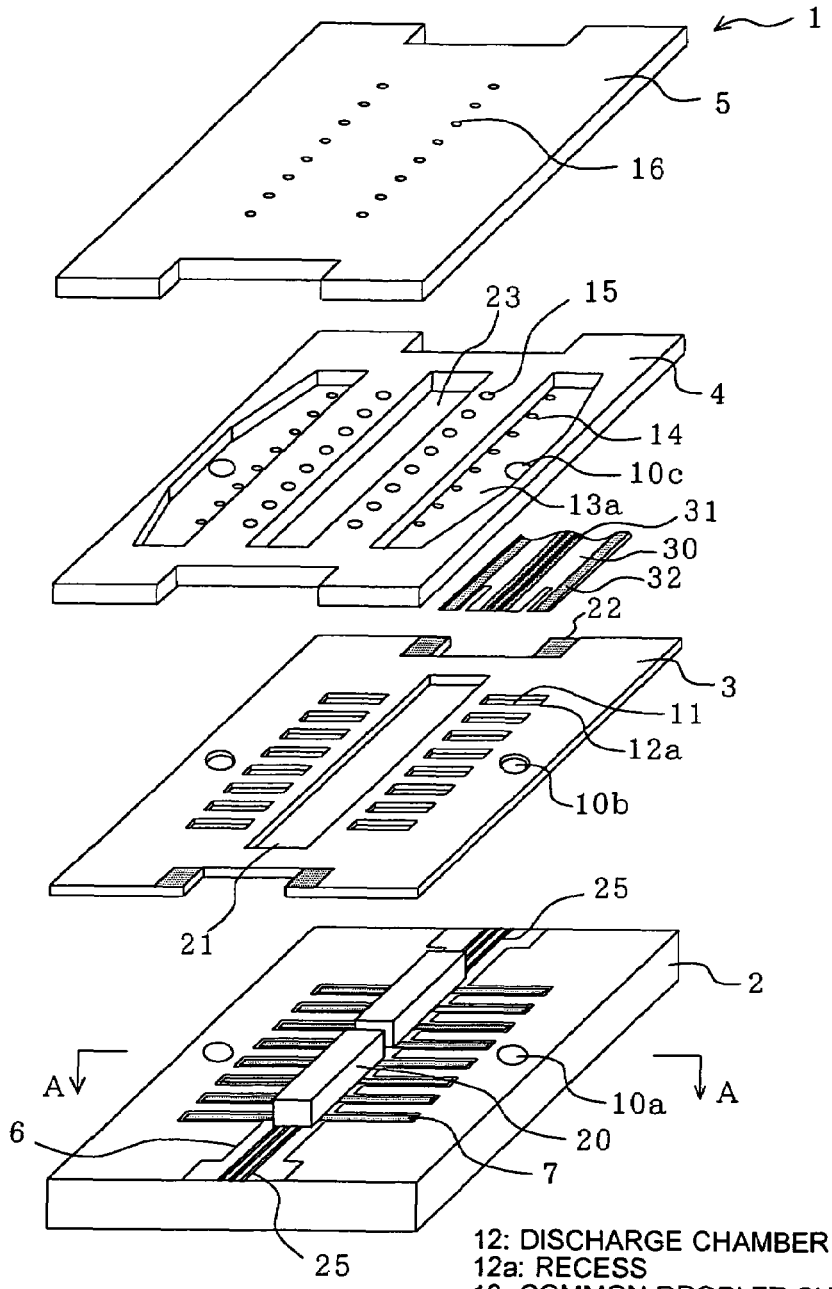

1: DROPLET DISCHARGE HEAD
2: ELECTRODE SUBSTRATE
3: CAVITY SUBSTRATE
4: RESERVOIR SUBSTRATE
5: NOZZLE SUBSTRATE
6: RECESS
7: SEPARATE ELECTRODE
10a: DROPLET SUPPLY PORT
10b: DROPLET SUPPLY PORT
10c: DROPLET SUPPLY PORT
11: DIAPHRAGM
12: DISCHARGE CHAMBER
12a: RECESS
13: COMMON DROPLET CHAMBER
13a: RECESS
14: THROUGH HOLE
15: NOZZLE COMMUNICATING HOLE
16: NOZZLE HOLE
20: DRIVER IC
21: FIRST HOLE
22: COMMON ELECTRODE
23: SECOND HOLE
25: LEAD
30: FPC
31: IC WIRE
32: COMMON-ELECTRODE WIRE

10: DROPLET SUPPLY PORT
17: SEALER
24: HOUSING

FIG. 6
(a)
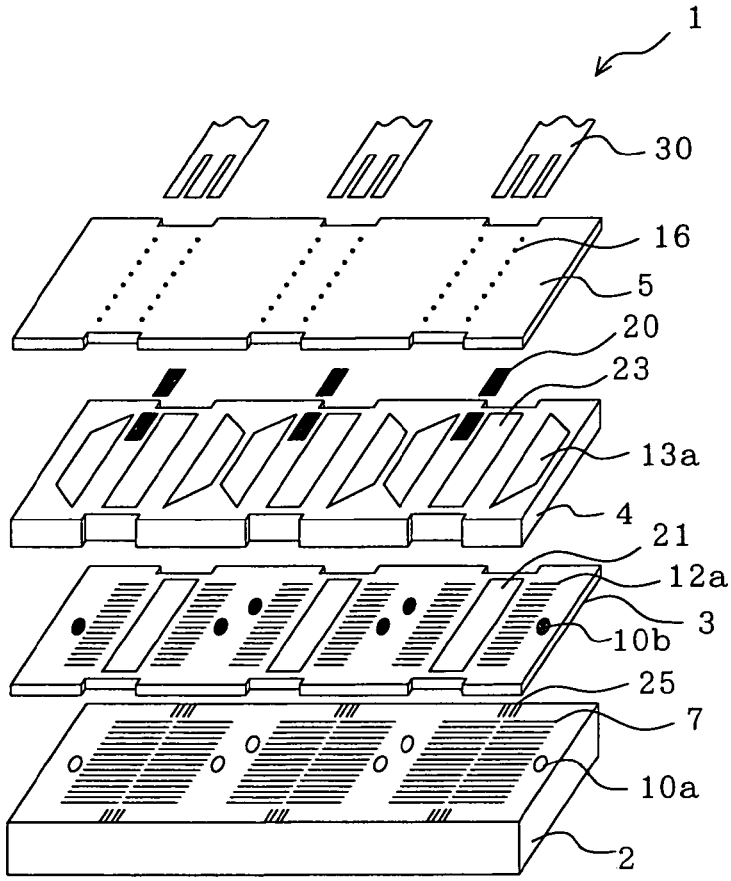
(b)
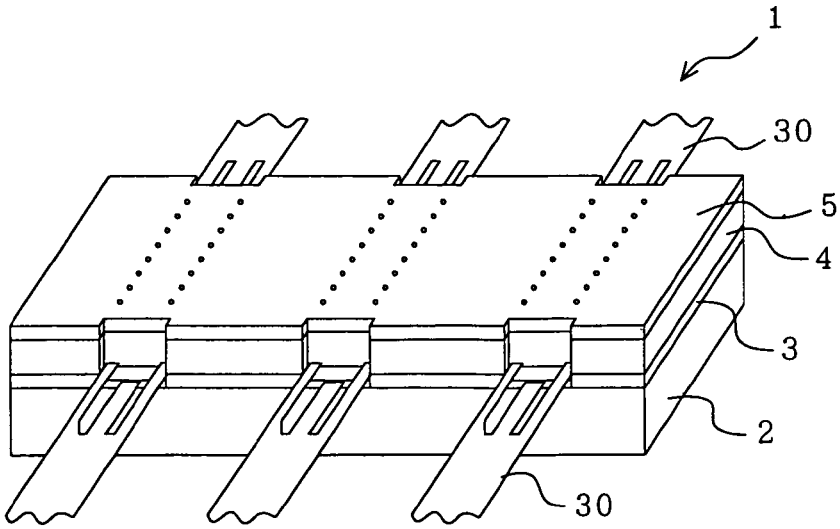

DROPLET JET HEAD AND DROPLET JET APPARATUS

The entire disclosure of Japanese Patent Application No. 2005-043513, filed Feb. 21, 2005, is expressly incorporated by reference herein.

BACKGROUND OF THE INVENTION

1. Field of the Invention

The present invention relates to a droplet jet apparatus, and in particular, it relates to a compact droplet jet head having multiple high-density rows of nozzles and ejection chambers, and a droplet jet apparatus including the same.

2. Description of the Related Art

As recent electrostatic inkjet printers are increasing in the number of nozzles and rows of the inkjet head for high-speed printing and multicolor printing of high-resolution images, the number of nozzles per row and ejection chambers increase, thus increasing the length of the nozzle rows. The nozzle rows generally eject different colors of ink (e.g., red, green, blue, etc.) row by row.

Known droplet jet heads and droplet jet apparatuses mount device-control ICs directly on the surface of a substrate having ink channels and thermoelectric transducers, and has a flexible printed circuit (FPC) for supplying an input signal for driving the device-control ICs on the substrate (e.g., refer to Patent Document 1: Japanese Unexamined Patent Application Publication No. 2002-210969, FIGS. 1 and 2).

However, in the known droplet jet heads and droplet jet apparatuses (e.g., Patent Document 1), the device-control IC constitutes part of the nozzle surface, which requires a layer for protecting the surface of the device-control IC from ink, posing the problem of complicating the structure and manufacturing process.

Also, because the device-control IC is exposed, it is susceptible to outside air and vibrations, resulting in low durability.

Furthermore, the device-control IC is closer to print paper than the nozzles. This results in a long spread distance of ink droplets, so that the ink droplets cannot reach predetermined positions, making it difficult to achieve high-definition printing.

Since the ink channel and the FPC are disposed in opposite sides with the IC therebetween, the droplet jet head becomes large when the number of nozzle rows is increased.

SUMMARY

Accordingly, it is an advantage of some aspects of the present invention to provide a compact and high-durability droplet jet head having multiple high-density rows of nozzles and ejection chambers, and a droplet jet apparatus including the same.

A droplet jet head according to a first aspect of the invention includes: a nozzle substrate having a plurality of nozzle holes that eject droplets; a cavity substrate having recesses whose bottoms serve as diaphragms, and the recesses serving as ejection chambers for storing the droplets; an electrode substrate having separate electrodes opposed to the diaphragms and driving the diaphragms; a reservoir substrate having a recess serving as a common droplet chamber for supplying droplets to the ejection chambers, through holes for transferring the droplets from the common droplet chamber to the ejection chambers, and nozzle communicating holes for transferring the droplets from the ejection chambers to the nozzle holes; and a driver IC that supplies a driving signal to the separate electrodes. The cavity substrate has a first hole, and the reservoir substrate has a second hole. The first hole and the second hole communicate with each other to form a housing, and the driver IC being housed in the housing.

Since the cavity substrate has a first hole, the reservoir substrate has a second hole, and the first hole and the second hole communicate with each other to form a housing, in which the driver IC is housed, the droplet jet head can be made compact. This decreases the distance between print paper and the nozzle to allow high-definition printing. Furthermore, since the surface on which the nozzles are formed can be made flat, wiping (the process of removing unnecessary droplets) can be facilitated.

Since the droplet jet head is constructed of four layers of the nozzle substrate, the reservoir substrate, the cavity substrate, and the electrode substrate, a large capacity of the reservoir for storing droplets can be provided to allow reduction in the resistance of a droplet channel.

In the droplet jet head, it is preferable that the first hole pass through the cavity substrate; the second hole pass through the reservoir substrate; and the housing is closed by the nozzle substrate, the cavity substrate, the reservoir substrate, and the electrode substrate.

Since the first hole passes through the cavity substrate, and the second hole passes through the reservoir substrate, the housing can have large capacity, allowing a relatively large driver IC to be housed therein.

Since the housing is closed by the nozzle substrate, the cavity substrate, the reservoir substrate, and the electrode substrate, there is no need to provide a separate layer for protecting the driver IC from droplets, and from outside air.

A droplet jet head according to a second aspect of the invention includes: a nozzle substrate having a plurality of nozzle holes that eject droplets; a cavity substrate having recesses whose bottoms serve as diaphragms, the recesses serving as ejection chambers for storing the droplets; an electrode substrate having separate electrodes opposed to the diaphragms and driving the diaphragms; a reservoir substrate having a recess serving as a common droplet chamber for supplying droplets to the ejection chambers, through holes for transferring the droplets from the common droplet chamber to the ejection chambers, and nozzle communicating holes for transferring the droplets from the ejection chambers to the nozzle holes; and a driver IC that supplies a driving signal to the separate electrodes. The cavity substrate has a hole; and the driver IC is housed in the hole.

Since the cavity substrate has a hole, in which the driver IC is housed, the droplet jet head can be made compact. This decreases the distance between print paper and the nozzle to allow high-definition printing. Furthermore, since the surface on which the nozzles are formed can be made flat, wiping (the process of removing unnecessary droplets) can be facilitated.

Since the droplet jet head is constructed of four layers of the nozzle substrate, the reservoir substrate, the cavity substrate, and the electrode substrate, a large capacity of the reservoir for storing droplets can be provided to allow reduction in the resistance of a droplet channel.

In the droplet jet head, it is preferable that the hole pass through the cavity substrate, and the hole be closed by the cavity substrate, the reservoir substrate, and the electrode substrate.

Since the hole is closed by the cavity substrate, the reservoir substrate, and the electrode substrate, there is no need to provide a separate layer for protecting the driver IC from droplets, and from outside air.

A droplet jet head according to a third aspect of the invention includes: a nozzle substrate having a plurality of nozzle holes that eject droplets; a cavity substrate having recesses whose bottoms serve as diaphragms, the recesses serving as ejection chambers for storing the droplets; an electrode substrate having separate electrodes opposed to the diaphragms and driving the diaphragms; and a driver IC that supplies a driving signal to the separate electrodes. The cavity substrate has a hole; and the driver IC is housed in the hole.

Since the cavity substrate has a hole, in which the driver IC is housed, the droplet jet head can be made compact. This decreases the distance between print paper and the nozzle to allow high-definition printing. Furthermore, since the surface on which the nozzles are formed can be made flat, wiping (the process of removing unnecessary droplets) can be facilitated.

In the droplet jet head, it is preferable that the hole pass through the cavity substrate, and the hole be closed by the nozzle substrate, the cavity substrate, and the electrode substrate.

Since the hole is closed by the nozzle substrate, the cavity substrate, and the electrode substrate, there is no need to provide a separate layer for protecting the driver IC from droplets, and from outside air.

In the droplet jet head, it is preferable that the driver IC be placed on the electrode substrate, and connects to the separate electrodes.

If the driver IC is disposed on the electrode substrate, and is connected directly to the separate electrodes, wiring of the separate electrodes (wiring for connection) becomes unnecessary. Thus the droplet jet head can be made compact and the number of separate electrodes of the electrode rows, to be described later, can be increased.

In the droplet jet head, it is preferable that the electrode substrate have a plurality of rectangular separate electrodes having long sides and short sides, the separate electrodes be arranged in such a manner that the long sides are parallel to each other to form a plurality of electrode rows extending along the short side of the separate electrodes, and the driver IC connect to two of the electrode rows.

Since the separate electrodes are disposed in parallel to form multiple electrode rows, and the driver IC connects to two electrode rows, a driving signal can be supplied from the driver IC to the two electrode rows, facilitating multiple number of electrode rows. Since the number of the drive ICs can be decreased, cost reduction can be achieved, and the droplet jet head can be made compact.

A droplet jet apparatus according to a third aspect of the invention includes one of the above-described droplet jet heads.

Since one of the droplet jet heads is mounted, a high-durability droplet jet apparatus capable of high-definition printing can be provided.

It is preferable that the droplet jet apparatus further include a flexile printed circuit (FPC) for supplying an external input signal to the driver IC, the driver IC connect to the FPC, and the FPC be connected to the driver IC in such a manner that a direction of a length of the FPC is parallel to a direction of the short sides of the separate electrodes that form the electrode rows.

Since the FPC connects to the driver IC in parallel to the short side of the separate electrode rows, the droplet jet head having multiple electrode rows and the FPC can be connected compactly.

In the droplet jet apparatus, it is preferable that the cavity substrate have a common electrode for applying voltage to the diaphragms, and the common electrode connect to the flexile printed circuit.

Since the FPC is connected also to the common electrode, a driving signal can be supplied to both of the separate electrodes and the diaphragms using one FPC.

It is preferable that the droplet jet apparatus further include a common-electrode IC for supplying a driving signal to the common electrode, and the common-electrode IC be disposed in other than the flexile printed circuit and the droplet jet head.

Since the common-electrode IC is disposed in other than the FPC and the droplet jet head, the driver IC can be made compact, so that the droplet jet head can also be made compact.

In the droplet jet apparatus, it is preferable that the driver IC supply a driving signal to the common electrode.

Since the driver IC supplies a driving signal to the separate electrodes and the common electrode, the droplet jet head can serve multiple functions.

In the droplet jet apparatus, it is preferable that the FPC have a driving-signal supply wire for supplying a driving signal from the driver IC to the common electrode.

Since the FPC has a driving-signal supply wire for supplying a driving signal from the driver IC to the common electrode, there is no need to have wiring in the droplet jet head, facilitating supply of a driving signal to the common electrode.

In the droplet jet apparatus, it is preferable that the FPC have a common-electrode IC for supplying a driving signal to the common electrode.

Since the FPC has a common-electrode IC for supplying a driving signal to the common electrode, the driver IC can be made compact, so that the droplet jet head can also be made compact.

BRIEF DESCRIPTION OF THE DRAWINGS

FIG. 1 is an exploded perspective view of a droplet jet head according to a first embodiment of the invention;

FIG. 6A is an exploded perspective view of a droplet jet head according to a third embodiment of the invention;

FIG. 6B is a perspective view of the droplet jet head according to the third embodiment;

DESCRIPTION OF THE PREFERRED EMBODIMENTS

First Embodiment

Figure 2:
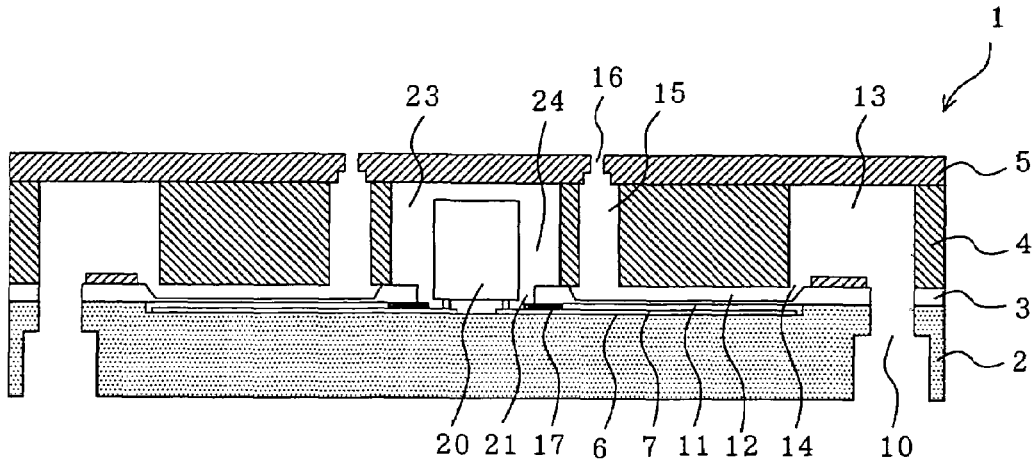
FIG. 2 is a longitudinal sectional view of the droplet jet head of FIG. 1 in an assembled state.

FIG. 1 is an exploded perspective view of a droplet jet head according to a first embodiment of the invention, including part of a flexible printer circuit (FPC) for supplying a driving signal. FIG. 2 is a longitudinal sectional view of the droplet jet head of FIG. 1 in an assembled state, taken along line A-A of FIG. 1.

The droplet jet head shown in FIGS. 1 and 2 is of a face ejection type that ejects droplets from nozzle holes provided on the surface of the nozzle substrate, and employs an electrostatic system. The structure and operation of the droplet jet head according to the first embodiment will now be described with reference to FIGS. 1 and 2.

As shown in FIG. 1, the droplet jet head 1 according to the first embodiment has not a three-layer structure, unlike general electrostatic droplet jet heads, but is constructed of four substrates of an electrode substrate 2, a cavity substrate 3, a reservoir substrate 4, and a nozzle substrate 5. One surface of the reservoir substrate 4 connects to the nozzle substrate 5; the other surface connects to the cavity substrate 3. The surface of the cavity substrate 3 opposite to the surface that connects to the reservoir substrate 4 connects to the electrode substrate 2. In other words, the substrates are joined in the order of the electrode substrate 2, the cavity substrate 3, the reservoir substrate 4, and the nozzle substrate 5.

The droplet jet head 1 according to the first embodiment has a driver IC 20 for supplying a driving signal to separate electrodes 7, to be described later. The driver IC 20 will be described later.

The electrode substrate 2 is made of glass such as borosilicate glass. Although the electrode substrate 2 is made of borosilicate glass in the first embodiment, the electrode substrate 2 may be made of monocrystal silicon.

The electrode substrate 2 has a recess 6 with a depth of 0.3 μm. Inside the recess 6, the separate electrodes 7 are formed so as to face a diaphragm 11, to be described later, at fixed intervals by the sputtering of, e.g., indium tin oxide (ITO) to a thickness of 0.1 μm. In the above example, the space between the separate electrode 7 and the diaphragm 11 becomes 0.2 μm after the electrode substrate 2 and the reservoir substrate 4 have been joined together. One end of the separate electrodes 7 connect to the driver IC 20, from which a driving signal is supplied. Part of the recess 6 is shaped in a somewhat large pattern similar to the shape of the separate electrode 7 so as to mount it; the other part (the central part in FIG. 1) is shaped in a pattern so that the driver IC 20 can be mounted on the electrode substrate 2, on which the driver IC 20 is mounted.

In the first embodiment, after the electrode substrate 2 and the cavity substrate 3 have been joined together, a sealer 17 is applied to the space between the separate electrode 7 and the diaphragm 11 to prevent foreign matter (refer to FIG. 2).

The electrode substrate 2 has droplet supply ports 10*a*. The droplet supply ports 10*a* pass through the electrode substrate 2.

In the droplet jet head 1 according to the first embodiment, each of the separate electrodes 7 is shaped like a rectangle having long sides and short sides. The separate electrodes 7 are arranged in such a manner that the long sides are parallel to each other to form two rows of electrodes along the short side of the separate electrode 7. For example, when the short side of the separate electrode 7 tilts relative to the long side to form a long parallelogram, an electrode row extending in the direction perpendicular to the long side may be formed.

In the droplet jet head 1 according to the first embodiment, the driver IC 20 is disposed between two electrode rows, and connects to both of the electrode rows. This allows the driver IC 20 to supply a driving signal to the two electrode rows, facilitating multiple electrode rows. Since the number of driver ICs 20 can be decrease, cost can be reduced and the droplet jet head 1 can be made compact.

Although the droplet jet head 1 shown in FIG. 1 has two driver ICs 20, it may have one IC or three or more ICs.

The cavity substrate 3 is made of, e.g., monocrystal silicon, and has multiple recesses 12*a* whose bottom walls are the diaphragms 11 and serving as ejection chambers 12. The recesses 12*a* are arranged in two rows in correspondence with the separate electrodes 7 (electrode rows). The cavity substrate 3 has a first hole 21 between the electrode rows, the first hole 21 passing through the cavity substrate 3, and common electrodes 22 for applying voltage to the diaphragm 11. The common electrodes 22 connect to a FPC 30.

In the first embodiment, the cavity substrate 3 is made of monocrystal silicon, all over which is formed a 0.1-μm insulating film (not shown) made of tetraethyl orthosilicate (TEOS) by plasma chemical vapor deposition (CVD). This is to prevent dielectric breakdown and short circuit when the diaphragm 11 is driven and to prevent the cavity substrate 3 from being etched by droplets of ink etc.

The cavity substrate 3 also has droplet supply ports 10*b* that pass through the cavity substrate 3.

The diaphragm 11 of the droplet jet head 1 may be made of a high-concentration boron-doped layer. When dopant is boron, the rate of etching of monocrystal silicon using alkaline solution such as potassium hydroxide is extremely low in high concentrations of about $5\times10^{19}$ atoms/cm$^3$ or more. Accordingly, when the diaphragm 11 is made of a high-concentration boron-doped layer, and the recesses 12*a* serving as the ejection chamber 12 is formed by anisotropic etching using alkaline solution, the boron-doped layer is exposed to decrease the etching rate significantly, which is called an etching stop technique, the diaphragm 11 can be formed in a desired thickness.

The reservoir substrate 4 is made of, e.g., monocrystal silicon, and has two recesses 13*a* serving as common droplet chambers 13 for supplying droplets to the ejection chamber 12. In the bottom of the recesses 13*a*, through holes 14 for transferring droplets from the common droplet chamber 13 to the ejection chamber 12 are provided.

The bottom of each recess 13*a* has a droplet supply port 10*c* that passes therethrough. The droplet supply ports 10*c* of the reservoir substrate 4, the droplet supply ports 10*b* of the cavity substrate 3, and the droplet supply ports 10*a* of the electrode substrate 2 connect to each other with the reservoir substrate 4, the cavity substrate 3, and the electrode substrate 2 joined together, to form droplet supply ports 10 for supplying droplets from the exterior to the common droplet chamber 13 (refer to FIG. 2).

Furthermore, between the common droplet chambers 13 of the reservoir substrate 4 is provided a second hole that passes through the reservoir substrate 4.

As shown in FIG. 2, the first hole 21 of the cavity substrate 3 and the second hole 23 of the reservoir substrate 4 communicate to form a housing 24. The housing 24 accommodates the driver IC 20.

The part of the reservoir substrate 4 other than the recesses 13*a* has nozzle communicating holes 15 that communicate with the ejection chambers 12, for transferring droplets from the ejection chambers 12 into nozzle holes 16 (to be described later). The nozzle communicating holes 15 pass through the reservoir substrate 4 to the end opposite to the end with which the through hole 14 of the ejection chamber 12 communicate (refer to FIG. 2).

The nozzle substrate 5 is formed of a silicon substrate of, e.g., 100 μm in thickness, and has a plurality of nozzle holes 16 communicating with the respective nozzle communicating holes 15. In the first embodiment, the nozzle holes 16 are disposed in two steps to improve the linearity at the time of ejection of droplets (refer to FIG. 2).

For the connection of the electrode substrate 2, the cavity substrate 3, the reservoir substrate 4, and the nozzle substrate 5, the silicon substrate and the borosilicate glass substrate can be connected by anode coupling; the silicon substrates can be connected by direct coupling, or with an adhesive.

As shown in FIG. 2, in the droplet jet head 1 according to the first embodiment, the driver IC 20 is housed in the housing 24, and the housing 24 is closed by the nozzle substrate 5, the cavity substrate 3, the reservoir substrate 4, and the electrode substrate 2. Specifically speaking, the housing 24 is closed in such a manner that the nozzle substrate 5 forms the upper surface of the housing 24; the electrode substrate 2 forms the lower surface of the housing 24; and the cavity substrate 3 and the reservoir substrate 4 form the sides of the housing 24. It is preferable that the housing 24 be closed for protect the driver IC 20 from droplets or outside air.

The operation of the droplet jet head shown in FIGS. 1 and 2 will now be described. To the common droplet chamber 13, droplets such as ink are supplied from the exterior through the droplet supply ports 10. To the ejection chamber 12, droplets are supplied from the common droplet chamber 13 through the through holes 14. To the driver IC 20, a driving signal (pulse voltage) is supplied from the controller (not shown) of the droplet jet apparatus via an IC wire 31 of the FPC 30 and a lead 25 (refer to FIG. 1) disposed on the electrode substrate 2. A pulse voltage ranging from 0 V to about 40 V is applied from the driver IC 20 to the separate electrodes 7 to charge the separate electrodes 7 positively. A driving signal (pulse voltage) is supplied to the diaphragm 11 from the controller (not shown) of the droplet jet apparatus via a common-electrode wire 32 (refer to FIG. 1) to charge it negatively. At that time, the diaphragm 11 is distorted toward the separate electrode 7 under the suction by an electrostatic force. When the pulse voltage is then turned off, the electrostatic force applied to the diaphragm 11 is lost to recover the diaphragm 11. At that time, the pressure in the ejection chamber 12 increases abruptly to force the droplets in the ejection chamber 12 to be ejected from the nozzle holes 16 through the nozzle communicating holes 15. Then droplets are supplied from the common droplet chamber 13 into the ejection chamber 12 through the through holes 14 to return the droplet jet head to the initial state.

The supply of droplets to the common droplet chamber 13 of the droplet jet head 1 is made, e.g., through a droplet supply tube (not shown) connected to the droplet supply port 10.

In the first embodiment, the FPC 30 connects to the driver IC 20 in such a manner that a direction of the length of the FPC 30 is parallel to a direction of the short sides of the separate electrodes 7 that forms an electrode row. For example, when the short side of the separate electrode 7 tilts relative to the long side to form a long parallelogram, the FPC 30 may be connected in the direction perpendicular to the long side of the separate electrode 7. This allows compact connection of the droplet jet head 1 having multiple electrode rows and the FPC 30.

Figure 3:
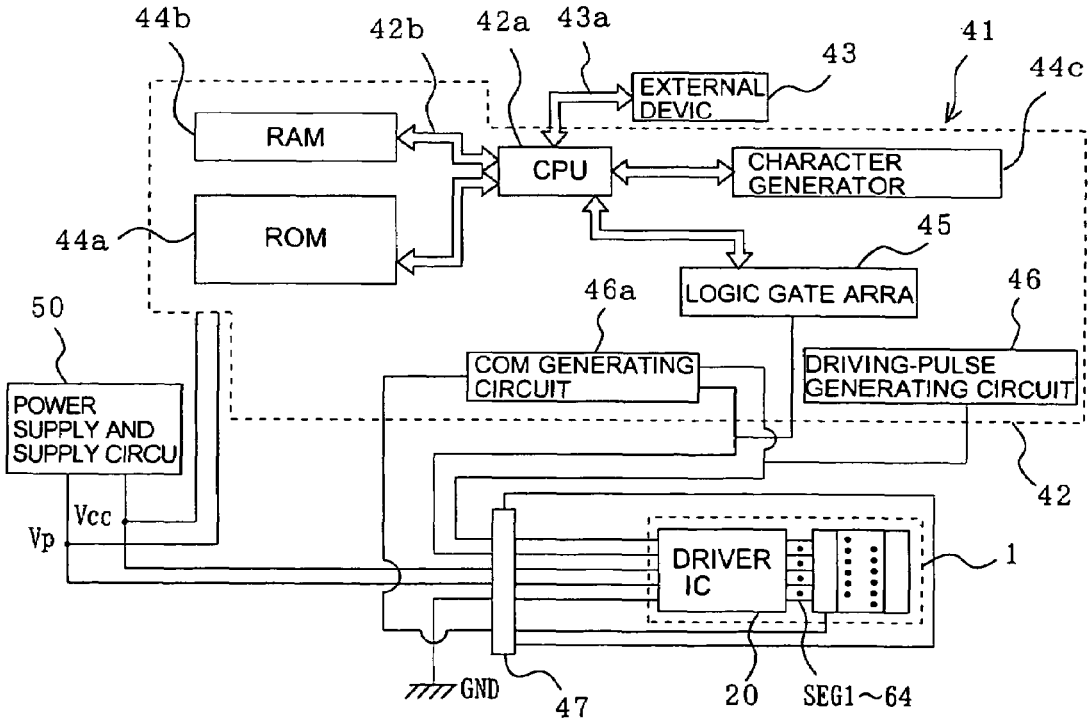
FIG. 3 is a schematic block diagram of the control system of a droplet jet apparatus having the droplet jet head shown in FIGS. 1 and 2.

FIG. 3 is a schematic block diagram of the control system of a droplet jet apparatus having the droplet jet head 1 shown in FIGS. 1 and 2. Assume that the droplet jet apparatus is a general inkjet printer. Although the control system of the droplet jet apparatus having the droplet jet head 1 will be described with reference to FIG. 3, the control system of the droplet jet apparatus having the droplet jet head 1 is not limited to the system shown in FIG. 3.

The droplet jet apparatus having the droplet jet head 1 shown in FIGS. 1 and 2 includes a droplet-jet-head drive control unit 41 for controlling the drive of the droplet jet head 1. The droplet-jet-head drive control unit 41 includes a controller 42 constituted primarily of a CPU 42*a*. The CPU 42*a* is provided with print information from an external device 43 such as a personal computer via a bus 43*a*, and connects to a ROM 44*a*, a RAM 44*b*, and a character generator 44*c* via an internal bus 42*b*.

The controller 42 executes a control program stored in the ROM 44*a* using the memory region in the RAM 44*b* as working region to generate a control signal for driving the droplet jet head 1 on the basis of character information generated by the character generator 44*c*. The control signal is converted to a drive control signal corresponding to print information via a logic gate array 45 and a driving-pulse generating circuit 46, and is supplied to the driver IC 20 in the droplet jet head 1 via a connector 47, and also to a COM generating circuit 46*a*. To the driver IC 20, also a print-driving pulse signal V3, a control signal LP, a polarity-reverse control signal REV, and other signals are supplied. The COM generating circuit 46*a* is constituted of a common-electrode IC (not shown) for generating a driving pulse, for example.

The COM generating circuit 46*a* outputs a driving signal (driving-voltage pulse) to be applied to the common electrodes 22 of the droplet jet head 1, that is, to the diaphragms 11, from its common output terminal COM (not shown) in response to the above-described signals supplied. The driver IC 20 outputs a driving signal (driving-voltage pulse) to be applied to the separate electrodes 7 from separate output terminals SEG of a number corresponding to the separate electrodes 7, according to the supplied signals and a driving voltage Vp supplied from a supply circuit 50. The potential difference between the output of the common output terminal COM and the output of the separate output terminals SEG is applied between the diaphragms 11 and the separate electrodes 7 opposed thereto. To drive the diaphragms 11 (to eject droplets), a driving potential waveform in a designated direction is applied; not to drive the diaphragm 11, no driving potential is applied.

Figure 4:
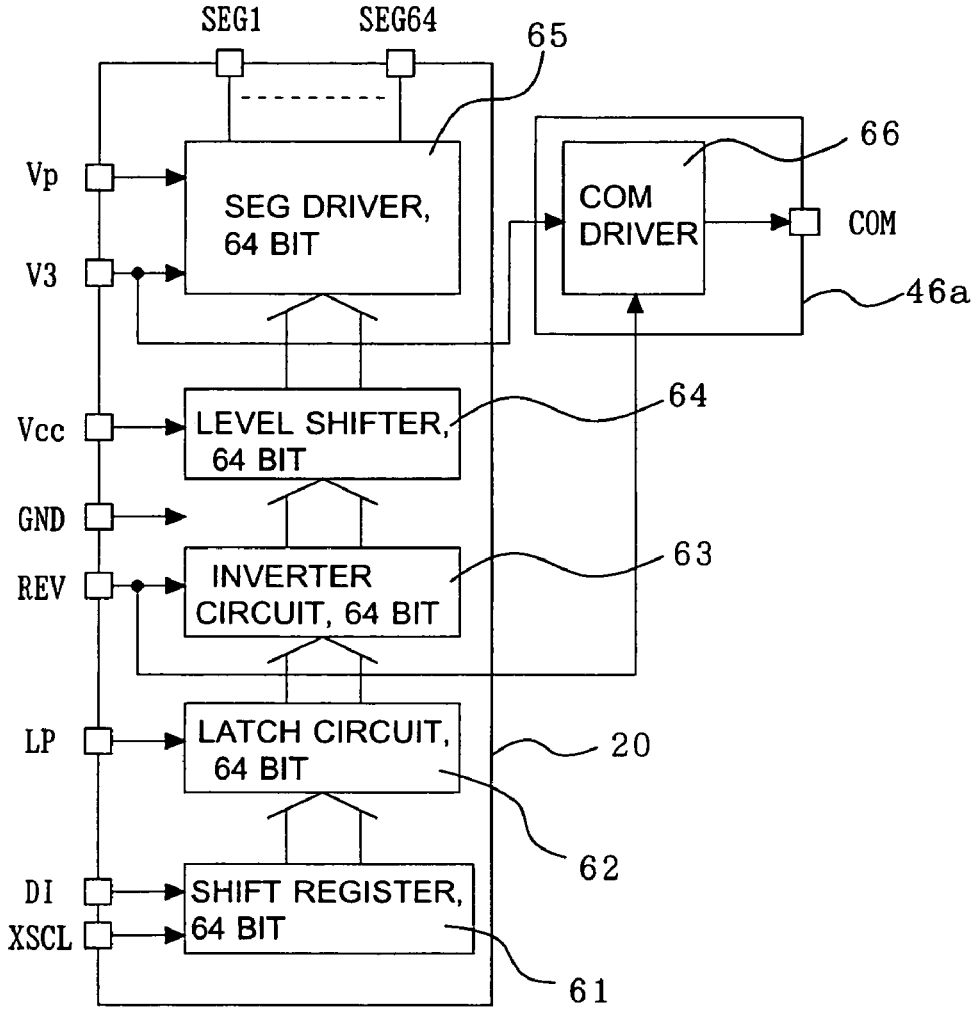
FIG. 4 is a schematic block diagram showing an example of the internal structure of a driver IC and a COM generating circuit.

FIG. 4 is a schematic block diagram showing an example of the internal structure of the driver IC 20 and the COM generating circuit 46*a*. One set of the driver IC 20 and the COM generating circuit 46*a* shown in FIG. 4 supply a driving signal to 64 separate electrodes 7 and diaphragms 11.

The driver IC 20 is a 64-bit high-pressure-proof driver for CMOS that operates at high-voltage driver voltage Vp and logic-circuit driver voltage Vcc supplied from a supply circuit 50. The driver IC 20 applies one of a drive-voltage pulse and a GND potential to the separate electrodes 7 in response to a drive control signal supplied.

The driver IC 20 has a 64-bit shift register 61. The shift register 61 is a static shift register that shifts up serial data in a 64-bit-lenth DI signal sent from a logic gate array 45 using an XSCL pulse signal that is a basic clock signal that synchronizes with the DI signal, and stores it in the register in the shift register 61. The DI signal is a control signal that indicates selection information for selecting an electrode from among 64 separate electrodes 7 by switching between on and off. The signal is sent as serial data.

The driver ID 20 includes a 64-bit latch circuit 62. The latch circuit 62 is a static latch that latches the 64-bit data stored in the shift register 61 according to a control signal (latch pulse) LP to store it, and signals the stored data to a 64-bit inverter circuit 63. The latch circuit 62 converts the DI signal of the serial data to a 64-bit parallel signal for 64-segment output for driving the diaphragms 11.

The inverter circuit 63 outputs the exclusive OR of the signal input from the latch circuit 62 and an REV signal to a level shifter 64. The level shifter 64 is a level interface circuit that converts the voltage level of the signal from the inverter circuit 63 to a logic voltage level (5-V level or 3.3-V level) to a head-driving voltage level (0- to 45-V level).

An SEG driver 65 serves as a 64-channel transmission gate, and outputs a driving voltage pulse or a GND potential in response to the segmented output of SEG1 to SEG 64 by the level shifter 64. A COM driver 66 in the COM generating circuit 46*a* outputs a driving voltage pulse or a GND potential to the COM in response to the input of an REV signal.

The XSCL-, DI-, LP-, and REV-signals are at a logic voltage level, and are sent from the logic gate array 45 to the driver IC 20.

With the structure of the driver IC 20 and the COM generating circuit 46*a*, the driving voltage pulse for driving the diaphragms 11 of the droplet jet head 1 and the GND can easily be switched even when the number of segments (the number of the diaphragms 11) to be driven increases.

In the first embodiment, the cavity substrate 3 has the first hole 21 and the reservoir substrate 4 has the second hole 23 to form the housing 24, in which the driver IC 20 is housed. Accordingly, the droplet jet head 1 can be made compact. This decreases the distance between print paper and the nozzle holes 16 to allow high-definition printing. Furthermore, since the surface on which the nozzle holes 16 are formed can be made flat, wiping (the process of removing unnecessary droplets) can be facilitated.

Also, since the housing 24 is closed by the nozzle substrate 5, the cavity substrate 3, the reservoir substrate 4, and the electrode substrate 2, there is no need to provide a separate layer for protecting the driver IC 20 from droplets, and from outside air.

Since the separate electrodes 7 are arranged in parallel to form multiple electrode rows, and the driver IC 20 connects to two electrode rows, a driving signal can be applied from the driver IC 20 to the two electrode rows, so that multiple electrode rows can easily be achieved. Since the number of the driver IC 20 can be decreased, cost reduction can be achieved, and the droplet jet head can be made compact.

Second Embodiment

Figure 5:
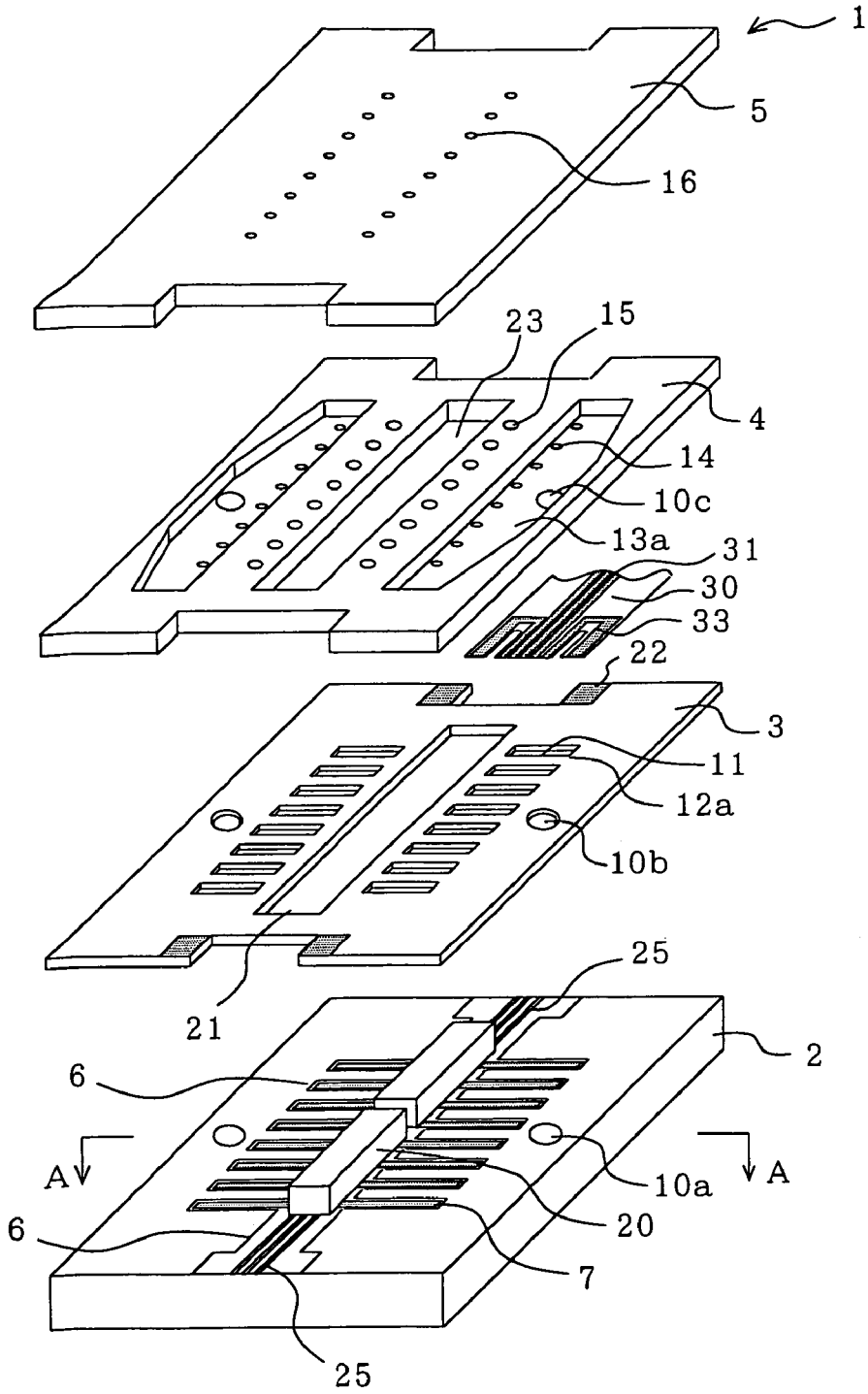
FIG. 5 is an exploded perspective view of a droplet jet head according to a second embodiment of the invention.

FIG. 5 is an exploded perspective view of a droplet jet head according to a second embodiment of the invention, including part of an FPC for supplying a driving signal.

In the droplet jet head 1 according to the second embodiment, the driver IC 20 serves also as the function of the COM generating circuit 46*a* in FIG. 3, and so supplies a driving signal to the common electrode 22 in addition to the separate electrodes 7. The FPC 30, which connects to the lead 25 and the common electrode 22, has a driving-signal supply wire 33 for supplying a driving signal from the driver IC 20 toe the common electrode 22, in place of the common-electrode wire 32.

The other structure and operation are the same as those of the droplet jet head 1 according to the first embodiment shown in FIGS. 1 and 2, and their description will be omitted here. Components the same as those of the droplet jet head 1 according to the first embodiment are given the same reference numerals.

According to the second embodiment, the driver IC 20 supplies a driving signal to the separate electrodes 7 and the common electrode 22. Accordingly, the droplet jet head 1 can serve many functions.

The FPC 30 has the driving-signal supply wire 33 for supplying a driving signal from the driver IC 20 to the common electrode 22. This eliminates the necessity for wiring in the droplet jet head 1, facilitating supplying a driving signal to the common electrode 22. Other advantages are the same as those of the droplet jet head 1 according to the first embodiment.

Third Embodiment

FIG. 6A is an exploded perspective view of a droplet jet head 1 according to a third embodiment of the invention; and FIG. 6B is a perspective view of the droplet jet head 1.

The droplet jet head 1 according to the third embodiment has six rows of separate electrodes 7, and corresponding six rows of recesses 12*a* serving as ejection chambers 12. Two driver ICs 20 are disposed for every two electrode rows, and so provide a driving signal to the electrode rows on both sides of the driver IC 20.

The other structure and operation are the same as those of the droplet jet head 1 according to the first embodiment shown in FIGS. 1 and 2, and their description will be omitted here. Components the same as those of the droplet jet head 1 according to the first embodiment are given the same reference numerals.

Since the third embodiment has six rows of electrodes, multiple colors can easily be ejected if different colors of ink are ejected from each ejection chambers 12 according to different electrode rows (the rows of the separate electrodes 7). Other advantages are the same as those of the droplet jet head 1 according to the first embodiment.

Fourth Embodiment

Figure 7:
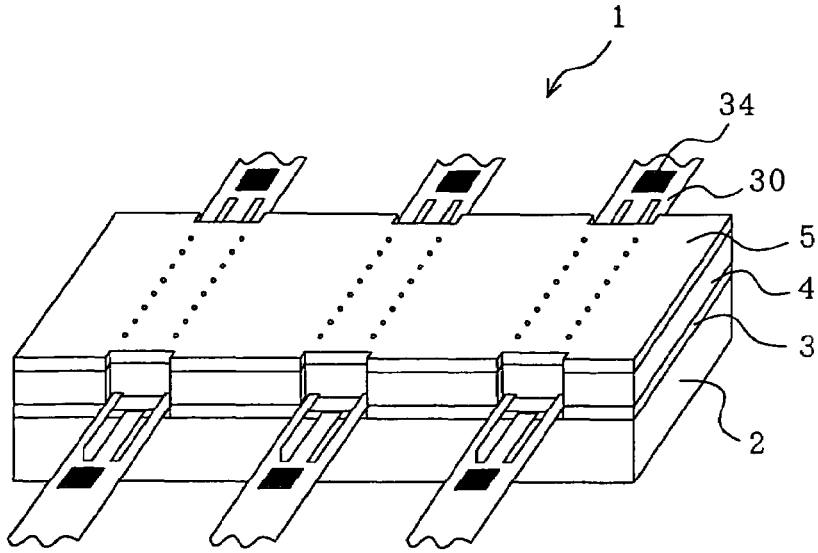
FIG. 7 is a perspective view of a droplet jet head according to a fourth embodiment of the invention.

FIG. 7 is a perspective view of a droplet jet head 1 according to a fourth embodiment of the invention. In the droplet jet head 1 according to the fourth embodiment, the FPC 30 has a common electrode 34. The common electrode 34 has the function of the COM generating circuit 46*a* in FIG. 3, and so supplies a driving signal to the common electrode 22. The other structure and operation are the same as those of the droplet jet head 1 according to the third embodiment shown in FIG. 6, so that their description will be omitted here. Components the same as those of the droplet jet head 1 according to the third embodiment are given the same reference numerals.

In the fourth embodiment, since the FPC 30 has the common electrode 34 for supplying a driving signal to the common electrode 22, the driver IC 20 can be made compact, so that the droplet jet head 1 can also be made compact. Other advantages are the same as those of the droplet jet head 1 according to the third embodiment.

Fifth Embodiment

Figure 8:
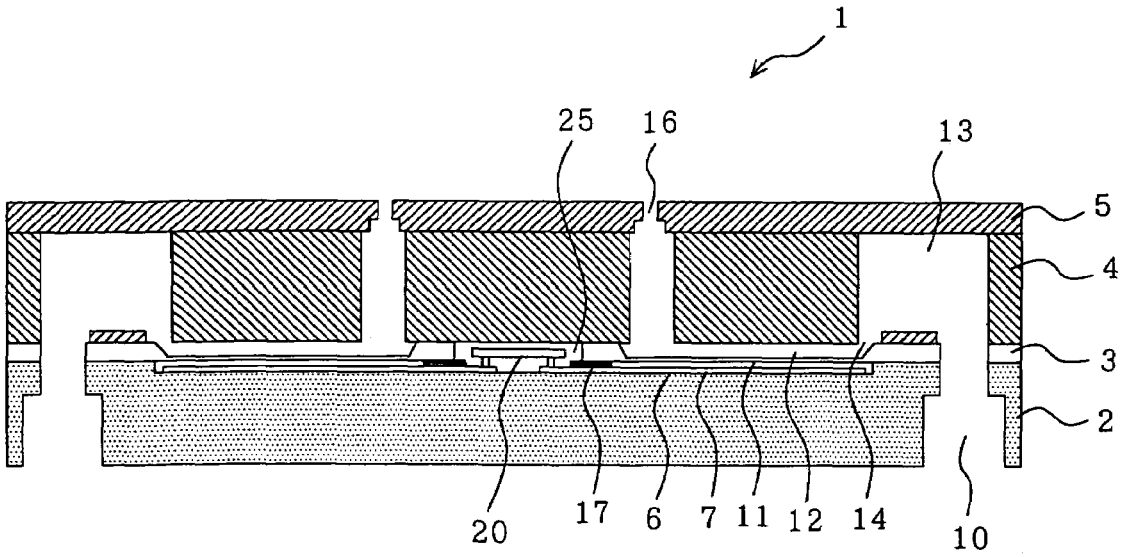
FIG. 8 is a longitudinal sectional view of a droplet jet head according to a fifth embodiment in an assembled state.

FIG. 8 is a longitudinal sectional view of a droplet jet head 1 according to a fifth embodiment in an assembled state. In the droplet jet head 1 according to the fifth embodiment, the reservoir substrate 4 has no second hole 23, and the cavity substrate 3 has a hole 26 corresponding to the first hole 21. The driver IC 20 is housed in the hole 26. The hole 26 is closed in such a manner that the reservoir substrate 4 forms the upper surface of the hole 26; the electrode substrate 2 forms the lower surface of the hole 26; and the cavity substrate 3 forms the sides of the hole 26.

The other structure and operation are the same as those of the droplet jet head 1 according to the first embodiment shown in FIGS. 1 and 2, and their description will be omitted here. Components the same as those of the droplet jet head 1 according to the first embodiment are given the same reference numerals.

The advantages are substantially the same as those of the droplet jet head 1 according to the first embodiment.

Sixth Embodiment

Figure 9:
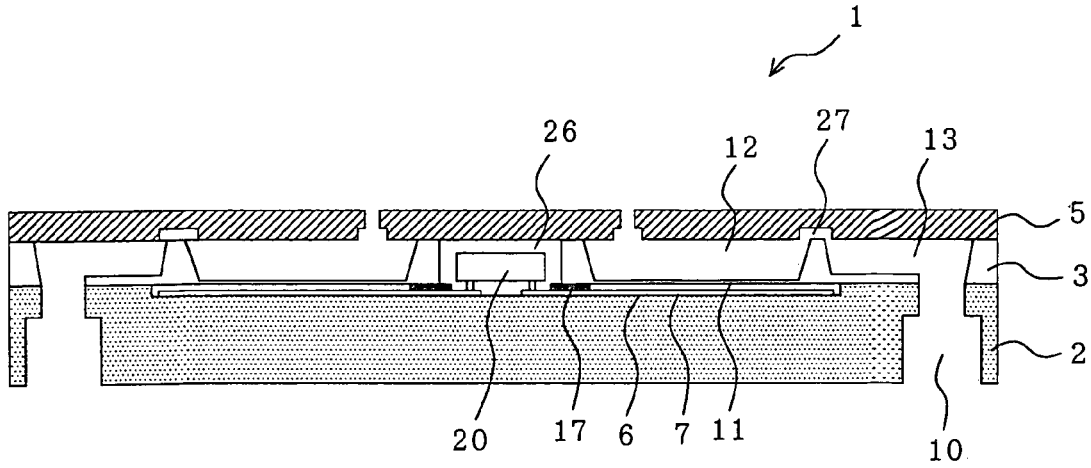
FIG. 9 is a longitudinal sectional view of a droplet jet head according to a sixth embodiment in an assembled state.

FIG. 9 is a longitudinal sectional view of a droplet jet head 1 according to a sixth embodiment in an assembled state.

The droplet jet head 1 according to the sixth embodiment has a general three-layer structure, and has no reservoir substrate 4, but is principally constructed of the electrode substrate 2, the cavity substrate 3, and the nozzle substrate 5. The recesses 13*a* serving as the common droplet chamber 13 are formed in the cavity substrate 3. The common droplet chamber 13 and the ejection chamber 12 communicate with each other through an orifice 27 formed in the nozzle substrate 5, in place of the through holes 14. The orifice 27 may be formed in the cavity substrate 3.

The droplet jet head 1 according to the sixth embodiment has two rows of separate electrodes 7. The cavity substrate 3 has the hole 26, as with the droplet jet head 1 according to the fifth embodiment. The hole 26 accommodates the driver IC 20. The electrodes may be arranged in three rows, as with the droplet jet head 1 according to the third embodiment. The hole 26 is closed in such a manner that the nozzle substrate 5 forms the upper surface of the hole 26; the electrode substrate 2 forms the lower surface of the hole 26; and the cavity substrate 3 forms the sides of the hole 26.

The other structure and operation are the same as those of the droplet jet head 1 according to the first embodiment shown in FIGS. 1 and 2, and their description will be omitted here. Components the same as those of the droplet jet head 1 according to the first embodiment are given the same reference numerals.

The advantages are substantially the same as those of the droplet jet head 1 according to the first embodiment.

Seventh Embodiment

Figure 10:
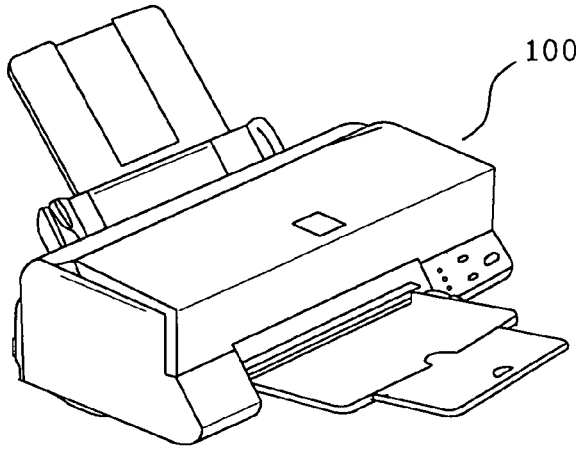
FIG. 10 is a perspective view showing an example of a droplet jet apparatus having the droplet jet head according to one of the first to sixth embodiments.

FIG. 10 is a perspective view showing an example of a droplet jet apparatus 100 incorporating the droplet jet head 1 according to one of the first to sixth embodiments. The droplet jet apparatus 100 shown in FIG. 10 is a general inkjet printer.

The droplet jet head 1 according to the first to sixth embodiments are compact and has excellent durability, and whose substrates are joined together with one FPC 30, as described above. Therefore, the droplet jet apparatus 100 is also compact and has high durability.

The droplet jet head 1 according to the first to sixth embodiments can also be applied to manufacture of color filters of a liquid crystal display, formation of the light emitting element of an organic EL display, ejection of biofluid, and so on through alternations of droplets, in addition to the inkjet printer shown in FIG. 10.

It is to be understood that the droplet jet head and the droplet jet apparatus of the invention is not limited to the foregoing embodiments of the invention, but may be modified within the scope and spirit of the invention. For example, the separate electrodes 7 may be arranged in one row. Although in to the first embodiment the common IC (COM generating circuit 46*a*) is disposed in the controller 42, it may be disposed in other than the FPC 30, the droplet jet head 1, and the controller 42.

What is claimed is:

1. A droplet jet head comprising:

a nozzle substrate having a plurality of nozzle holes that eject droplets;

a cavity substrate having recesses whose bottoms serve as diaphragms, and the recesses serving as ejection chambers for storing the droplets;

an electrode substrate having separate electrodes opposed to the diaphragms and driving the diaphragms;

a reservoir substrate having a recess serving as a common droplet chamber for supplying droplets to the ejection chambers, through holes for transferring the droplets from the common droplet chamber to the ejection chambers, and nozzle communicating holes for transferring the droplets from the ejection chambers to the nozzle holes; and a driver IC that supplies a driving signal to the separate electrodes; wherein the cavity substrate has a first hole, and the reservoir substrate has a second hole, the first hole and the second hole communicating with each other to form a housing, and the driver IC being housed in the housing;

the first hole passes through the cavity substrate;

the second hole passes through the reservoir substrate; and the housing is closed by the nozzle substrate, the cavity substrate, the reservoir substrate, and the electrode substrate.

2. The droplet jet head according to claim 1, wherein the driver IC is placed on the electrode substrate, and connects to the separate electrodes.

3. The droplet jet head according to claim 1, wherein the electrode substrate has a plurality of rectangular separate electrodes having long sides and short sides, the separate electrodes being arranged in such a manner that the long sides are parallel to each other to form a plurality of electrode rows extending along the short side of the separate electrodes; and the driver IC connects to two of the electrode rows.

4. A droplet jet apparatus comprising the droplet jet head according to claim 1.

5. The droplet jet apparatus according to claim 4, further comprising a flexile printed circuit for supplying an external input signal to the driver IC, the driver IC connecting to the flexile printed circuit, and the flexile printed circuit being connected to the driver IC in such a manner that a direction of a length of the flexible printed circuit side is parallel to a direction of the short sides of the separate electrodes that form the electrode rows.

6. The droplet jet apparatus unit according to claim 5, wherein the cavity substrate has a common electrode for applying voltage to the diaphragms, the common electrode connecting to the flexile printed circuit.

7. The droplet jet apparatus according to claim 6, further comprising a common-electrode IC for supplying a driving signal to the common electrode, the common-electrode IC being disposed in other than the flexile printed circuit and the droplet jet head.

8. The droplet jet apparatus according to claim 6, wherein the driver IC supplies a driving signal to the common electrode.

9. The droplet jet apparatus according to claim 6, wherein the flexile printed circuit has a common-electrode IC for supplying a driving signal to the common electrode.

10. The droplet jet apparatus according to claim 8, wherein the flexile printed circuit has a driving-signal supply wire for supplying a driving signal from the driver IC to the common electrode.

* * * * *